US007137280B2

(12) United States Patent
Capka et al.

(10) Patent No.: US 7,137,280 B2
(45) Date of Patent: Nov. 21, 2006

(54) CYLINDER LOCK, ESPECIALLY FOR MOTOR VEHICLES

(75) Inventors: Ales Capka, Javornice (CS); Simon Holub, Rychnov nad Knezou (CS)

(73) Assignee: FAB s.r.o., Rychnov nad Kneznou (CZ)

( * ) Notice: Subject to any disclaimer, the term of this patent is extended or adjusted under 35 U.S.C. 154(b) by 0 days.

(21) Appl. No.: 10/720,815

(22) Filed: Nov. 24, 2003

(65) Prior Publication Data

US 2004/0250579 A1 Dec. 16, 2004

(30) Foreign Application Priority Data

May 22, 2001 (CH) ..... PV 2001-1801
Nov. 4, 2002 (CH) ..... PV 2002-1294

(51) Int. Cl.
*E05B 27/00* (2006.01)

(52) U.S. Cl. ..... 70/492; 70/379 R; 70/218

(58) Field of Classification Search ..... 70/492, 70/218, 379 R, 221–223
See application file for complete search history.

(56) References Cited

U.S. PATENT DOCUMENTS 3,167,944 A * 2/1965 Pickering ..... 70/382
3,499,209 A * 3/1970 Laviana ..... 29/437
3,699,790 A * 10/1972 Ansala ..... 70/492
5,263,348 A * 11/1993 Wittwer ..... 70/379 R
5,265,453 A * 11/1993 Konii et al. ..... 70/379 R
5,295,377 A * 3/1994 Moricz et al. ..... 70/379 R
5,775,147 A * 7/1998 Wittwer ..... 70/379 R
6,439,016 B1 * 8/2002 Wittwer et al. ..... 70/379 R
6,684,672 B1 * 2/2004 Hermansson et al. ..... 70/379 R
6,854,306 B1 * 2/2005 Furlong ..... 70/379 R
6,868,705 B1 * 3/2005 Miao ..... 70/492
6,871,520 B1 * 3/2005 Armstrong et al. ..... 70/492
2003/0041636 A1 * 3/2003 Hermansson et al. ..... 70/379 R
2003/0089149 A1 * 5/2003 Suzuki et al. ..... 70/492
2004/0255627 A1 * 12/2004 Shimon ..... 70/379 R
2005/0103072 A1 * 5/2005 Lee ..... 70/492

* cited by examiner

*Primary Examiner*—Suzanne Dino Barrett
(74) *Attorney, Agent, or Firm*—Notaro & Michalos P.C.

(57) ABSTRACT

A cylinder lock, especially for motor vehicles, comprising a housing (1) in the inner cylindrical cavity of which there is arranged a cylinder core (2) that is equipped with a key channel (22) and spring-loaded tumblers (20, 20'), wherein, when no appropriate key is fully inserted into the key channel (22), blocking projections (201) of the tumblers (20, 20') protrude into a blocking groove (13, 13') formed in a member in which the cylindrical core (2) is supported for turning and, when the appropriate key is fully inserted, the blocking projections (201) of the tumblers (20, 20') do not extend beyond the periphery of the cylindrical core, wherein the cylinder lock is further provided with means for coupling the cylindrical core (2) with an output member (3) of the cylinder lock when the cylindrical core is being turned by the appropriate key, and for uncoupling of the cylindrical core (2) from the output member (3) of the cylinder lock when the cylinder core is turned by means of a false key or forcibly, the essence of which resides in that the cylindrical inner cavity of the housing (1) is provided with through-turnable annular grooves (11), and that at least one rib (12) which delimits the adjacent through-turnable groove (11) at that axial side that lies opposite to the direction (o) of a disengagement axial displacement of the cylindrical core (2) from the output member (3) is interrupted by at least one blocking groove (13), while blocking groove lateral surfaces (130, 131) diverge in the direction (o) of the disengagement axial displacement of the cylinder core (2) from the output member (3).

10 Claims, 8 Drawing Sheets

CYLINDER LOCK, ESPECIALLY FOR MOTOR VEHICLES

BACKGROUND OF THE INVENTION

1. Field of the Invention

The invention relates to a cylinder lock, especially for motor vehicles, the cylinder core of which that is provided with a key channel and spring-loaded tumblers is coupled, by means of an axial coupling, with an output member when the cylinder core is turned by means of an appropriate key, and is uncoupled therefrom when the cylinder core is turned by means of an inappropriate key or forcibly by a foreign body. In the course of unauthorized turning of the cylinder core, disengagement of the coupling from the output member of the cylinder lock occurs, so that it is possible to turn the cylinder core of the cylinder lock without any effect on a door lock latch with which the output member of the cylinder lock is mechanically coupled.

2. Description of Related Art

Cylinder locks of this kind, especially for motor vehicles, are already known. The aforementioned coupling or uncoupling of the cylinder core with the output member is accomplished, in most cases, by means of an axial coupling which, in the first end position of its axial translational movement, connects the output member of the cylinder lock with the cylinder core and, in the second end position of its axial translational movement, uncouples the output member of the cylinder lock from the cylinder core.

Cylinder lock constructions of this sort are known, for instance, from the published German applications DE 43 16 223 A1 and DE 196 04 350 A1, in each of which an axially movable cage is turnably supported in a cylindrical internal cavity of the housing, while a cylinder core provided with a key channel and equipped with spring-loaded tumblers is supported in a cylindrical hollow space of the cage. In the event that no appropriate key is fully introduced into the key channel, blocking projections of the tumblers project beyond the outer circumference of the cylinder core and engage in blocking grooves of the cage. Under these circumstances, the cylinder core is connected with the cage for joint turning and, when the cylinder core is being turned, the cage is simultaneously turned with the latter in the housing as well. Because the outer end face of the cage is provided with a detent part provided with a lifting profile that engages a corresponding detent part of the end projection of the housing, there is encountered, during the turning of the cage, a change in its position relative to the housing as a result of the axial movement of the cage. During this axial movement, an axially displaceable coupling, which simultaneously constitutes an output member of the cylinder lock, is shifted out of engagement with the cylinder core, as a result of which the kinematic connection between the cylinder core and the output member is discontinued, and it is possible afterwards to turn the cylinder core without acting on the door lock latch.

A disadvantage of these and similar constructions is that the use of the turnable and axially movable cage either prevents and/or makes considerably more expensive the provision of any additional safety elements between the cylinder core and the housing of the cylinder lock, such as, for instance, any protective measures against the extraction of the cylinder core out of, or its impacting into, the housing.

An annular, axially displaceable coupling is known from the German patent document DE 44 10 783 C1; it is provided at its inner end portion with an entraining recess for coupling with coupling projections provided on the axial extension of the cylinder core, and includes at its outer end portion an arresting projection that is to serve for the engagement with an arresting recess formed in the housing of the cylinder lock. This annular axially displaceable coupling is in permanent turnfast connection with the output member of the cylinder lock, while it engages in the arresting recess in the uncoupled condition from the cylinder core by means of its aforementioned arresting projection, as a result of which the output member of the cylinder lock is arrested in its position. Uncoupling of this annular axially displaceable coupling from the cylinder core is achieved by means of a detent part formed on the end face of the cage that is turnably mounted in the housing of the cylinder lock and is provided with a lifting profile that is entrained by the cylinder core for joint turning therewith in the event of forcible or unauthorized turning of the latter. The aforementioned lifting profile shifts the axially displaceable coupling out of its connection with the cylinder core against the force of a helical spring acting in the opposite direction, and moves the coupling in a turnfast engagement connection with the arresting recess provided in the housing of the cylinder lock.

When it is desired, after an effort to force the cylinder lock open, to open the latter again with the appropriate key, the cylinder core must be turned, jointly with the cage, into an initial position of the cylinder core, in which the relative positions of the detent part and the associated detent counterpart provided at the end face of the cage and at the facing end face of the annular coupling make possible an axial return movement of the coupling with the aid of the aforementioned axial helical spring, as a result of which there is obtained not only uncoupling from the housing but also connection of the coupling with the cylinder core for joint turning therewith.

A disadvantage of this axially displaceable coupling is its complicated and, from the manufacturing standpoint, demanding axial guidance in the housing of the cylinder lock, the need for the utilization of the cage equipped with the detent part for its axial displacement, as well as the use of a less reliable spring element for the axial return displacement of the coupling in engagement with the cylinder core.

SUMMARY OF THE INVENTION

The aforementioned disadvantages are essentially avoided by a cylinder lock, especially for motor vehicles, in accordance with the preamble of the independent claim, the essence of which consists in that a cylindrical inner cavity of the housing is provided with through-turnable annular grooves, and that at least one rib that delimits the adjacent groove at that axial side which lies opposite to the direction of axial displacement of the cylinder core during which disengagement of a coupling interposed between the cylinder core and the output member takes place is interrupted by at least one blocking recess, while the lateral surfaces of the latter diverge in the direction of the axial displacement of the cylinder core during which the disengagement of the coupling between the cylinder core and the output member takes place.

As a result of this construction, there is obtained a separation of the coupling between the cylinder core and the output member of the cylinder lock without the use of a cage interposed between the cylinder core and the housing, which renders possible the arrangement of formations on the cylinder core and on the housing that embody security measures against extraction of the cylinder core out of or its impacting into the housing.

It is advantageous when the housing is constituted by two housing halves that are rigidly connected with one another. This construction renders possible not only manufacture of the through-turnable annular grooves and of the blocking recesses in the ribs situated in the cylindrical inner cavity of the housing in a manner that is simple from the manufacturing standpoint, but also a simple installation of the cylinder lock.

It is advantageous when the cylindrical inner cavity of the housing is provided with at least one annular support groove, in which there is received, with an axial leeway (a), an annular outer collar of the cylinder core, wherein the axial leeway (a) corresponds to at least the extent (b) of the axial displacement that is required for the disengagement of the coupling. Such a construction, in essence, prevents the extraction of the cylinder core out of, or its forced impacting into, the housing.

It is advantageous when the blocking recesses of the paired holding arrangements in the housing are distributed at 180° relative to one another. Such a construction makes the manufacture of the cylinder lock simpler and makes possible a sufficient number of lock combinations.

It is advantageous when the lateral surfaces of the blocking recesses are constituted by planar facets that enclose the same acute angle (β) with a plane of symmetry of the blocking groove. Such a construction not only simplifies the manufacturing technology, but also assures an unproblematic sliding of the holding arrangements on the inclined side surfaces of the blocking recesses.

It is advantageous when the axial extension of the cylinder core is provided with a first axial abutment that unequivocally determines the position of first coupling elements of the entraining member when in engagement with second coupling elements of the axial extension of the cylinder core, and the cylinder core is provided with a second axial abutment that unequivocally determines the position of the first coupling elements of the entraining member when out of engagement with the second coupling elements of the axial extension of the cylinder core. This construction renders possible mounting of the entraining member in the housing that is simple from the manufacturing standpoint, and its reliable axial displacement both in engagement with the cylinder core and in engagement with the housing while using a minimum number of constituent parts of the cylinder lock.

It is advantageous when the second coupling elements are constituted by a first radial recess and by an oppositely located second radial recess which are formed in an annular collar provided on the axial extension, wherein there is formed between the annular collar and an inner offset surface of the cylinder core an annular groove a first annular lateral surface of which that faces toward the inner offset surface constitutes the second axial abutment, where the first coupling elements are constituted by inner radial projections of the entraining member. By resorting to this construction, one achieves both a minimum length of the cylinder core and a minimum length of the displacement of the coupling elements into and out of mutual engagement.

It is advantageous when a diameter of the axial extension at least behind the annular collar is greater than the diameter of a bottom of the annular groove, when concave end faces of the radial projections contact the bottom of the annular groove, wherein the first radial recess is recessed into the axial extension at least to the bottom of the annular groove and its second annular groove lateral surface that faces toward the output member constitutes the first axial abutment, while the second radial recess is recessed into the axial extension below the bottom of the annular groove and is terminated from one side at the first annular groove lateral surface, while it merges in the opposite direction into a second slip-on groove the bottom of which is separated from an oppositely situated surface of the axial extension at the maximum by a distance (L) that is equal to the diameter (D1) of the bottom of the annular groove. This construction renders possible not only reduction of the number of the constituent parts of the cylinder lock to a minimum, but also simple manufacture of the cylinder core by a molding process.

It is advantageous when the diameter (D2) of the axial extension behind the annular collar is equal to or smaller than the diameter (D1) of the bottom of the annular groove and the first axial abutment is constituted by an end face of a security disk or a stop member or a nut which is arranged on the axial extension behind the annular collar without any leeway. This construction is more advantageous for the manufacture of the cylindrical core by a material removing technique.

It is advantageous when a return spring is accommodated in a blind axial bore provided in the axial extension. This construction renders possible a further reduction in the length of the cylinder lock.

BRIEF DESCRIPTION OF THE DRAWING

In the accompanying drawings, there are illustrated several examples of the embodiment of the invention, wherein the individual views show.

DETAILED DESCRIPTION OF THE INVENTION

Figure 1:
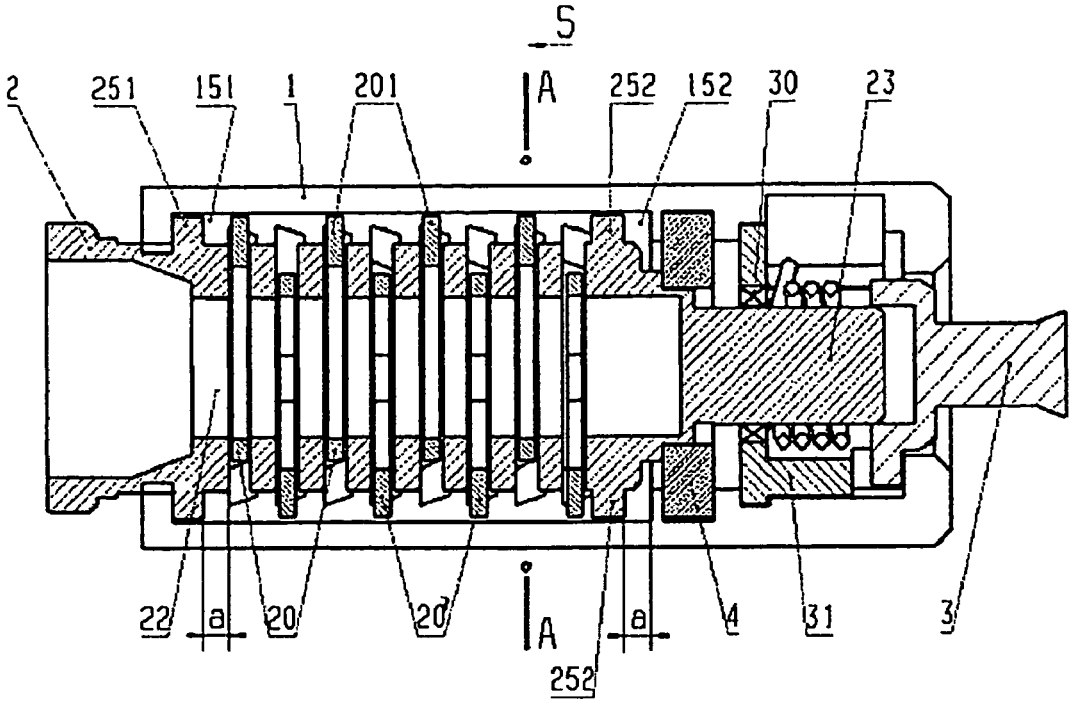
FIG. 1 a longitudinal section through a parting plane of the cylinder lock (section B—B of FIG. 3) with engaged coupling of the alternative I, FIG. 2 a longitudinal section through the parting plane of the cylinder lock (section H—H of FIG. 4) with the disengaged coupling of the alternative I, FIG. 3 a view of a section A—A of FIG. 1 in the direction S, FIG. 4 a view of a section F—F of FIG. 2 in the direction S, FIG. 5 a section D—D of FIG. 3 of the front part of the cylinder lock with the tumblers, FIG. 6 a section G—G of FIG. 4 of the front part of the cylinder lock with the tumblers, FIG. 7 a perspective view of essential parts of the disassembled cylinder lock according to alternative I, FIG. 8 a longitudinal section through the cylinder lock with the engaged coupling according to the alternative II, FIG. 9 a longitudinal section through the cylinder lock with the disengaged coupling according to the alternative II, FIG. 10 a longitudinal section through the axial extension, FIG. 11 a plan view of the axial extension of FIG. 10, FIG. 12 a section K—K of FIG. 11, FIG. 13 a view of the axial extension of FIG. 4 in the direction V, FIG. 14 a section L—L through the entraining member of FIG. 15, FIG. 15 a side elevational view of the entraining member, FIG. 16 a view of the entraining member of FIG. 14 in the direction W, FIG. 17 a perspective view of the entraining member, FIG. 18 a perspective view of the disassembled cylinder lock according to the alternative II.
Figure 2:
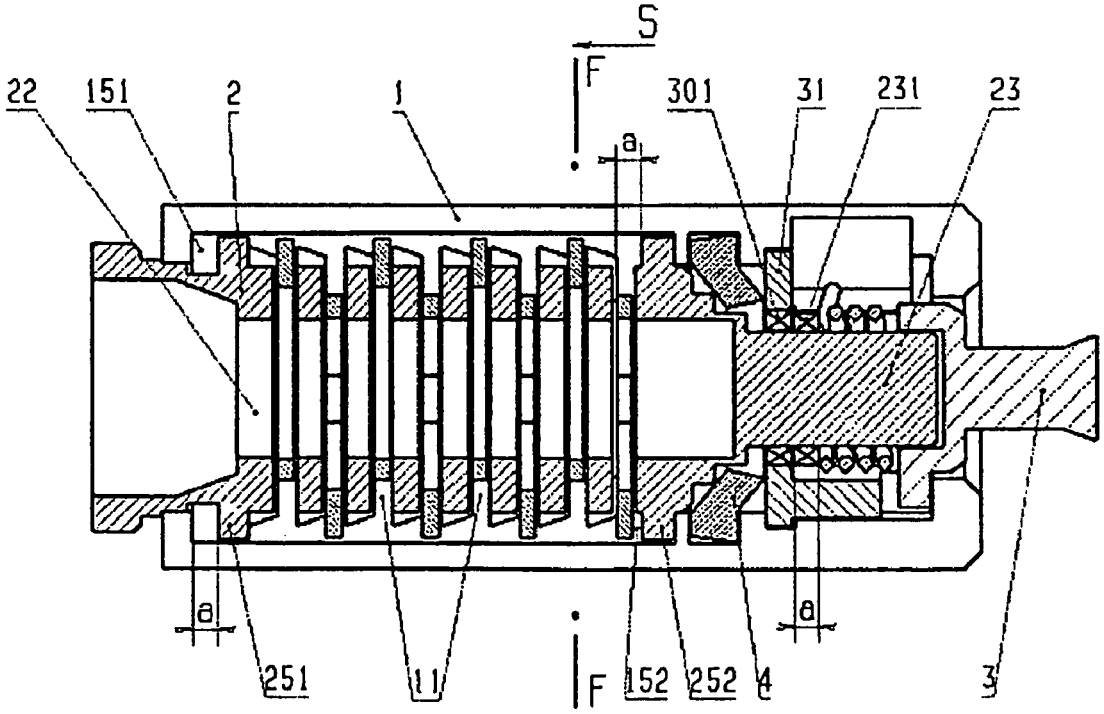
Figure 3:
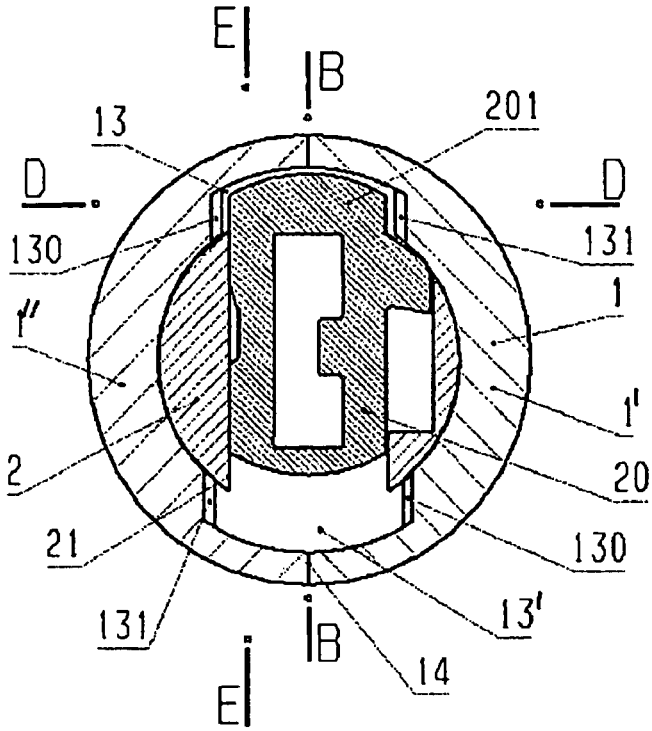
Figure 4:
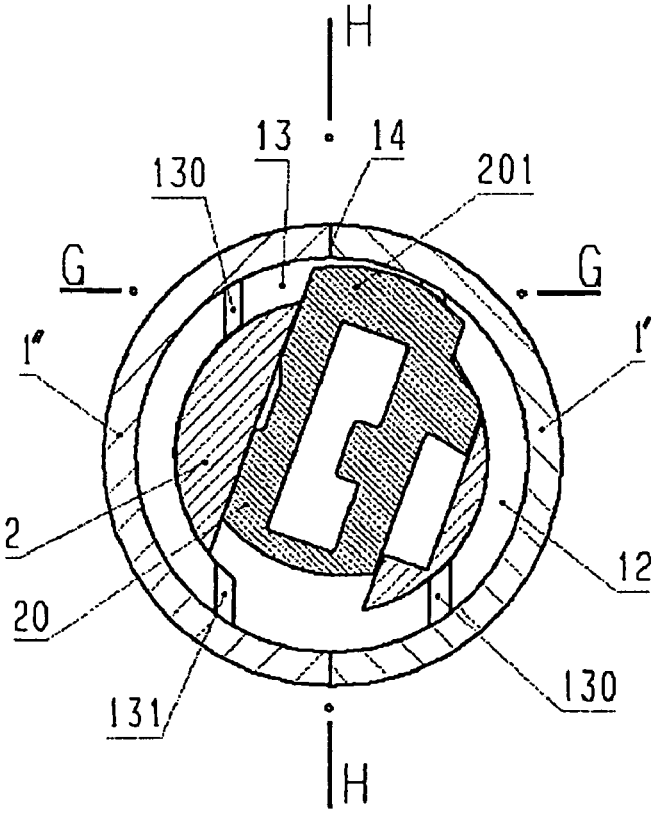
Figure 5:
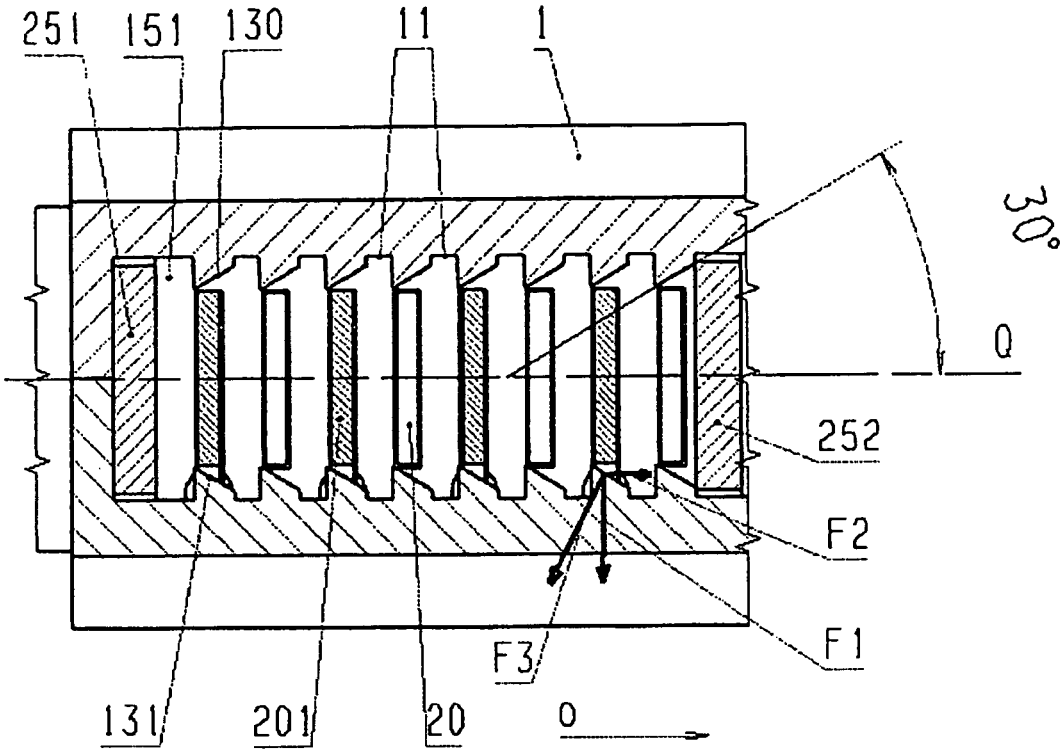
Figure 6:
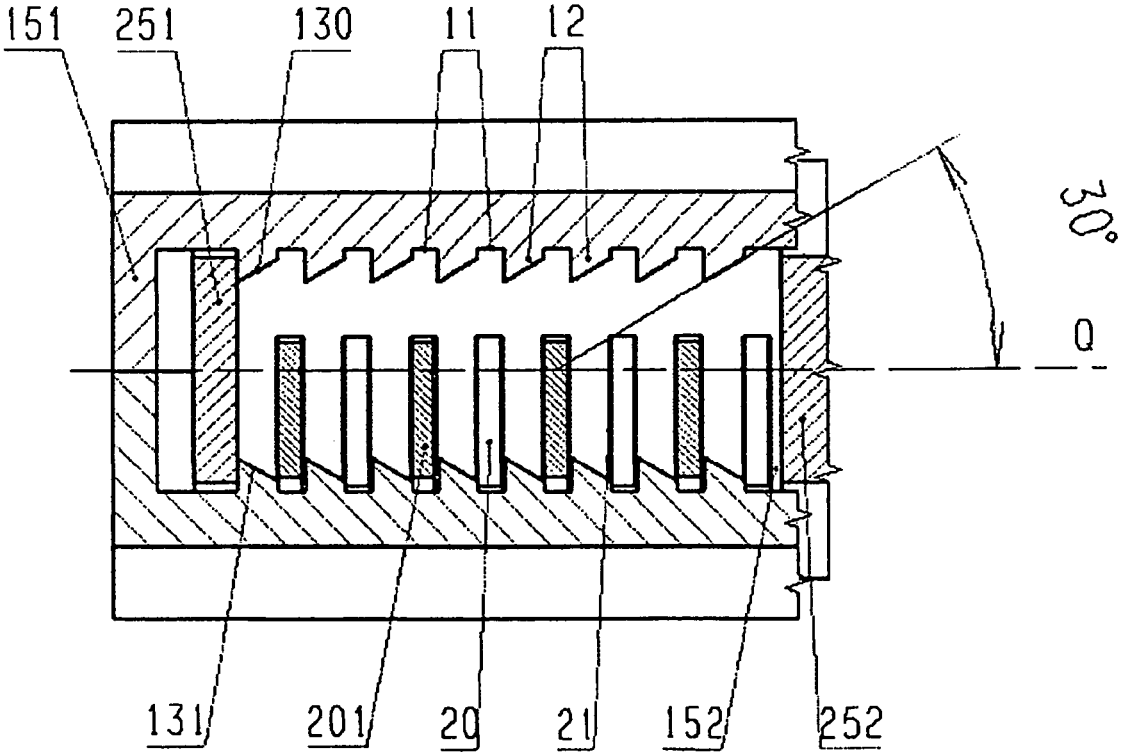
Figure 7:
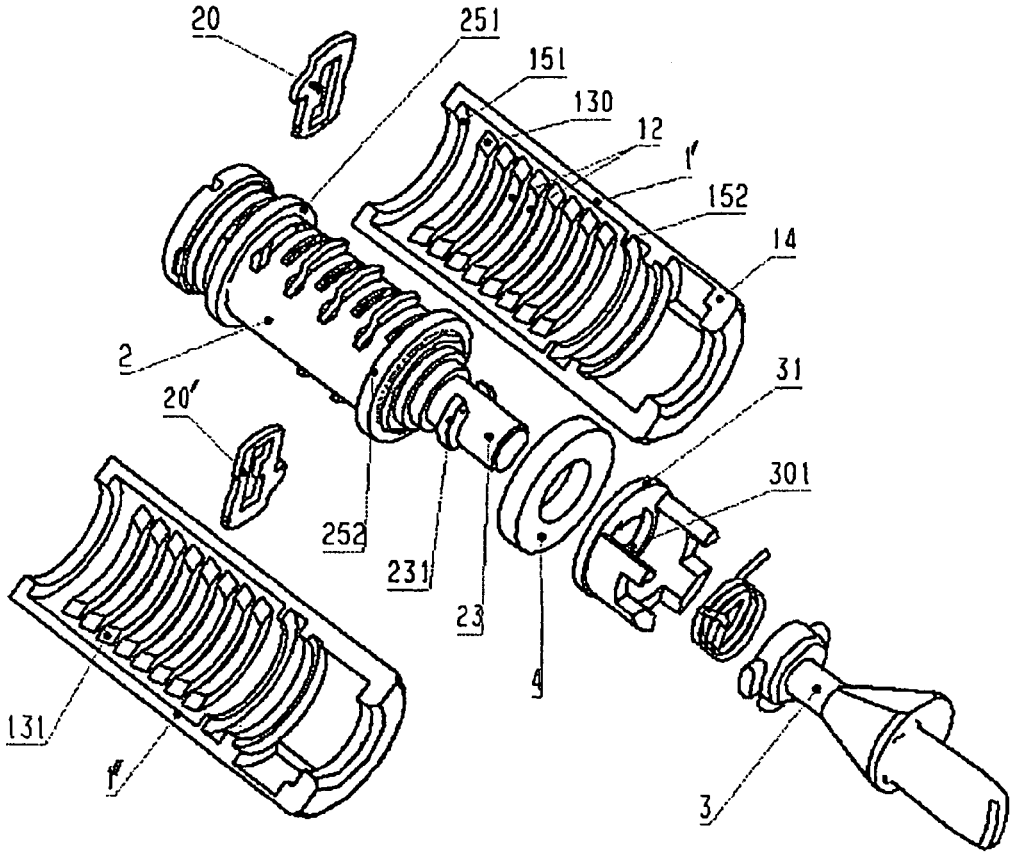
Figure 8:
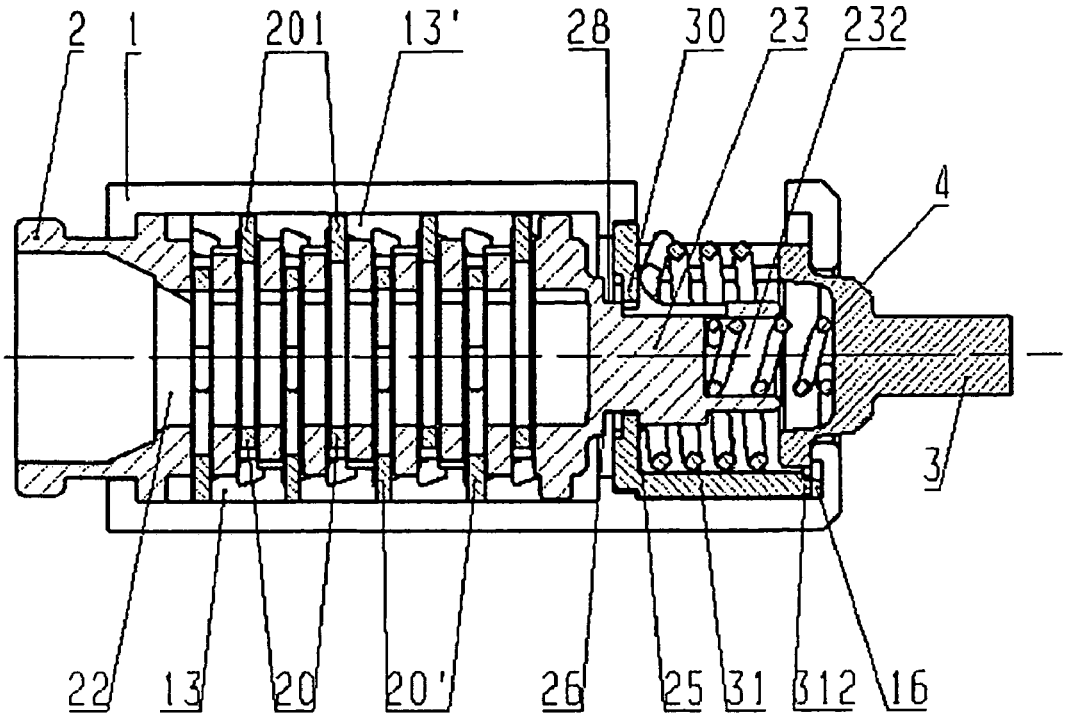
Figure 9:
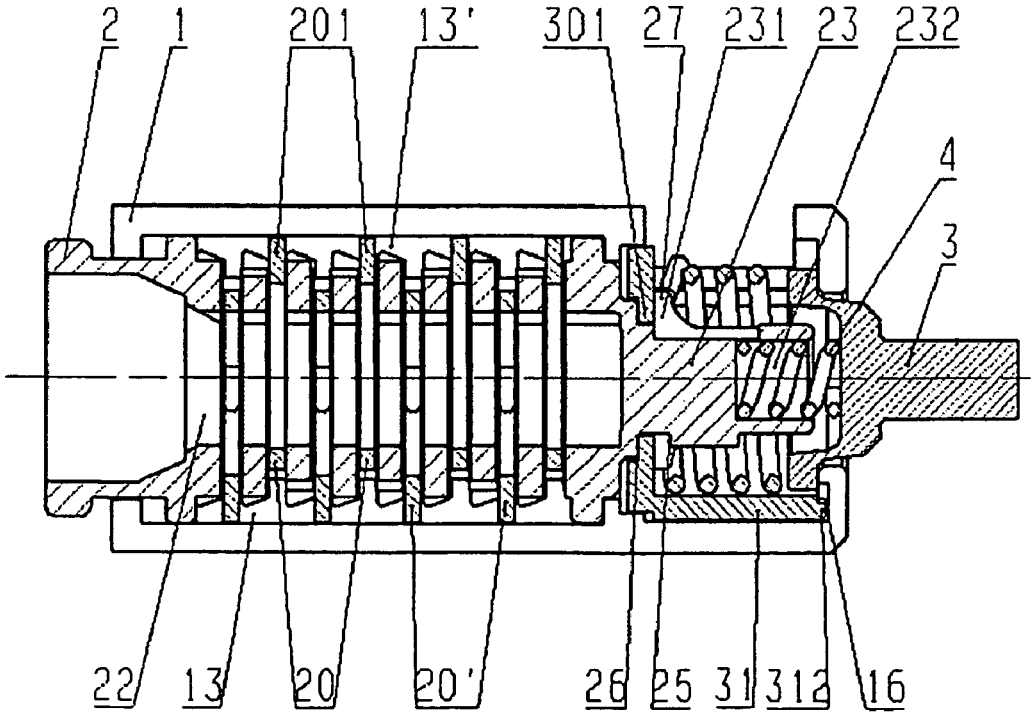
Figure 10:
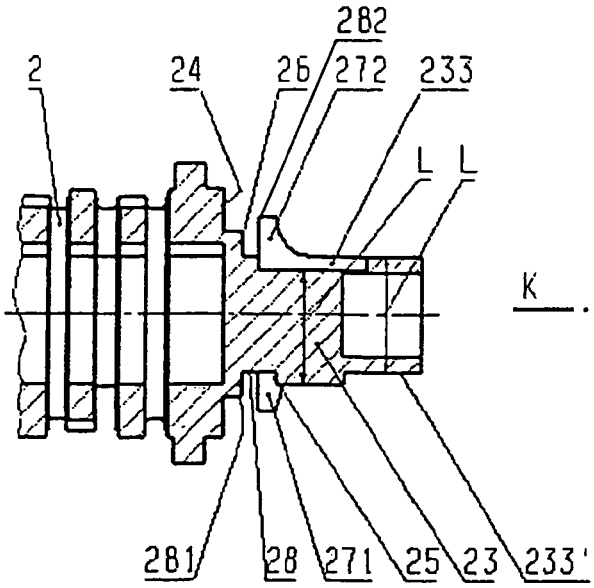
Figure 11:
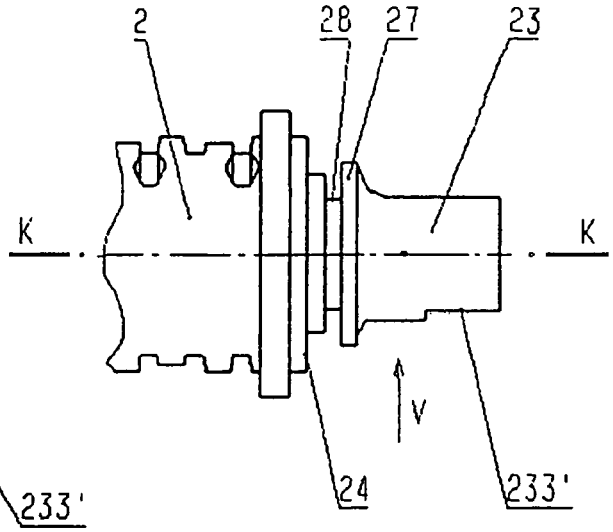
Figure 12:
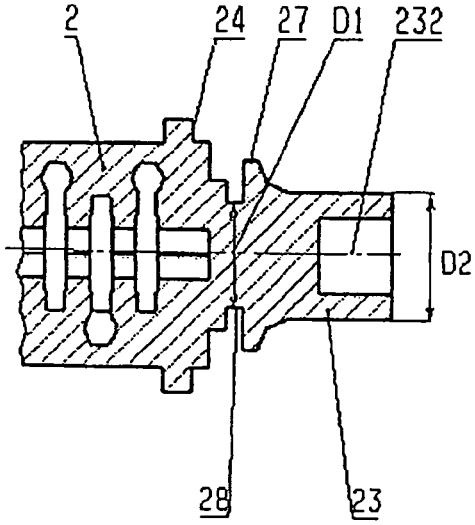
Figure 13:
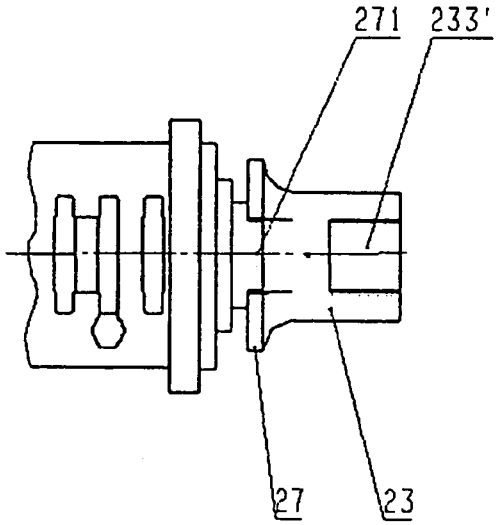
Figure 14:
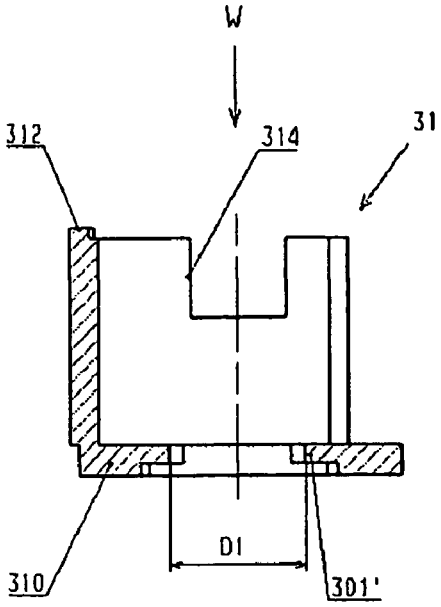
Figure 15:
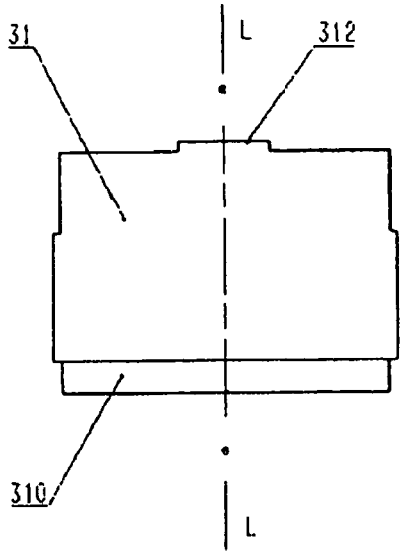
Figure 17:
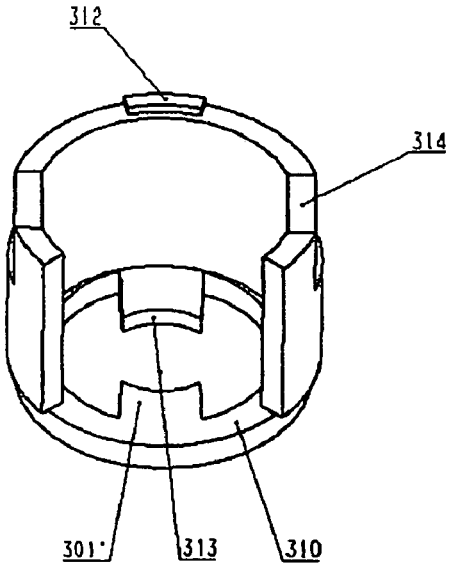
Figure 16:
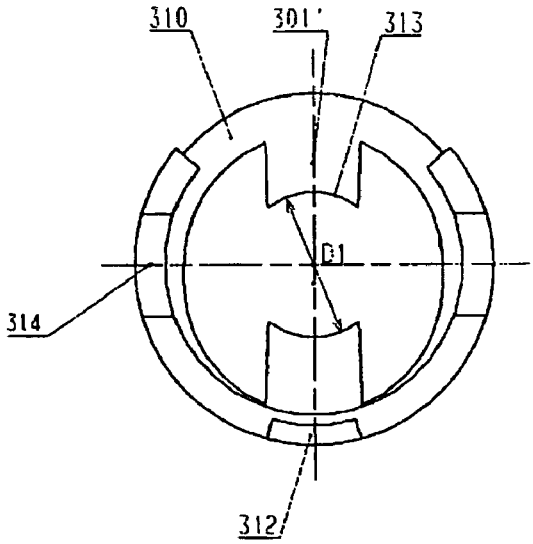
Figure 18:
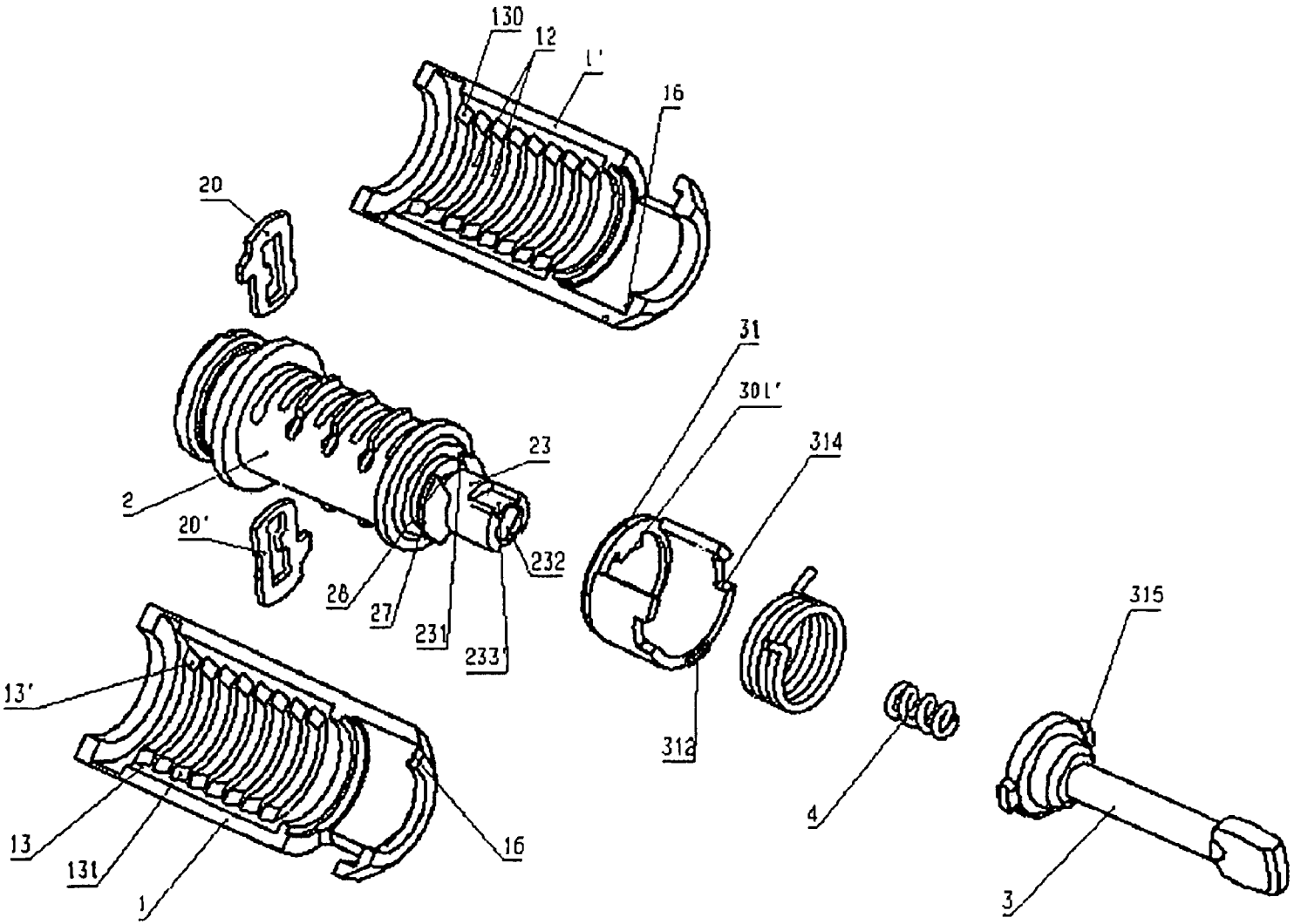

There are illustrated, in FIG. 1 to FIG. 7 of the drawing the alternative I, and in FIG. 8 to FIG. 18 the alternative II, of the cylinder lock. The two alternatives I and II differ from one another by the structural implementation of the coupling 30, of the entraining member 31, and of the return spring 4, 4'.

As may be observed in the accompanying drawing, the cylinder lock includes a housing 1 that is composed of two housing halves 1', 1" that are rigidly connected with one another. The parting plane 14 of the two housing halves 1', 1" is identical with the symmetry plane Q of the blocking grooves 13, 13'. As may be ascertained from FIG. 1 and FIG. 3, a cylindrical core 2 provided with a key channel 22 and with tumblers 20, 20' that are supported in compartments 21 is received in a cylindrical cavity of the housing 1. The tumblers 20, 20' are spring-biased and, when the appropriate key is fully inserted into the channel 22, the blocking projections 201 of the tumblers 20, 20' extend beyond the outer circumference of the cylindrical core 2 and project into the blocking grooves 13, 13' that are formed in the ribs 12 provided in the inner cylindrical cavity of the housing 1 symmetrically along the parting plane 14 of the housing 1. Blocking projections 201 of the tumblers 20 project into the blocking grooves 13 and blocking projections 201' of the tumblers 20', which are shifted under the influence of spring forces in the opposite direction than the tumblers 20, project into the blocking grooves 13'. The blocking grooves 13, 13' are delimited by blocking groove lateral surfaces 130, 131 that are formed at the end faces of the ribs 12. The blocking groove lateral surfaces 130, 131 enclose with the longitudinal symmetry plane Q of the blocking groove 13 an acute angle β. The lateral surfaces 201, 201' of the tumblers 20, 20' contact the aforementioned blocking groove lateral surfaces 130, 131 when it is attempted to turn the cylindrical core 2 without an appropriate key being fully inserted, or by using brute force. When the appropriate key is fully inserted into the key channel 22, the tumblers 20, 20' become arranged in such a manner that their blocking projections 201, 201' do not extend beyond the outer circumference of the cylindrical core 2 and it is possible to turn the cylindrical core 2 freely in the housing 1. In the course of turning the cylindrical core 2 with the appropriate key, the output member 3 of the cylinder lock that is coupled with the cylindrical core 2 by a coupling 30 in this functional condition, is jointly turned with it as well. In the alternative I, the coupling 30 consists of second coupling elements 231 provided on an axial extension 23, and of first coupling elements 301 provided on an axially immovable entraining member 31 that is turnably supported by its outer circumference in a cylindrical cavity of the housing 1 and is in permanent turnfast connection with the output member 3 of the cylinder lock. Of course, another construction of the coupling 30 can be conceived of as well, for instance such in which the second coupling element 231 of the axial extension 23 directly engages the first coupling element 301 provided on the axially unshiftable output member 3. The output member 3 of the cylinder lock is mechanically connected with a non-illustrated door lock latch.

When an inappropriate key is inserted into the key channel 22, or when an attempt is made forcibly to turn the cylindrical core 2 while the tumblers 20, 20' are outwardly shifted, the lateral surfaces of the blocking projections 201, 201' contact the blocking groove lateral surfaces 130 of the blocking groove 13, 13' (see FIGS. 3 and 5) as the cylindrical core 2 is being turned in the counterclockwise direction, and they engage the blocking groove lateral surfaces 131 as the cylindrical core 2 is being turned in the clockwise direction. Inasmuch as the blocking groove lateral surfaces 130, 131 are configured as inclined planar facets (see FIGS. 5 and 6), which diverge in the direction o of the disengaging axial displacement of the cylindrical core 2 and enclose an acute angle β with the symmetry plane Q of the blocking grooves 13, 13' there is encountered during such turning of the cylindrical core 2 sliding of the lateral surfaces of the blocking projection 201, 201' along the inclined facets of the blocking groove lateral surfaces 130, 131 and their axial displacement in the direction o. As a result of this, there is brought about an axial displacement of the cylindrical core 2, in the compartments 21 of which the tumblers 20, 20' are supported, in the direction o as well. The axial displacement of the tumblers 20, 20' comes about as a result of the resolution of the force F1 (see FIG. 5) into a force component F3 that acts normal to the blocking groove lateral surface 130, and a second force component F2 that causes an axial displacement of the tumblers 20, 20' in the direction o. The force F1 stems from the torque applied to the cylindrical core 2 during the forcible opening attempt.

In the course of this axial displacement of the cylindrical core 2, during the displacement to the extent of the displacement distance b that corresponds to the length of the second coupling element 231 (see FIG. 2), shifting occurs of the second coupling element 231 provided on the axial extension 23 of the cylindrical core 2 out of the first coupling element 301 provided on the entraining member 31. The shifting out of the second coupling element 231 occurs against the force of a return spring 4 that is configured in the shape of a disk spring, and continues until disengagement of the coupling 30 occurs, that is until the moment when the blocking projections 201 slide from the inclined blocking groove lateral surfaces 130, 131 of the blocking grooves 13, 13' into the turn-through annular grooves 11 (see FIG. 4). In this position, the coupling 30 between the cylindrical core 2 and the output member 3 of the housing 1 is already disengaged so that, during the further turning of the cylindrical core 2 in the course of which, owing to the guidance of the blocking projections 201, 201' in the turn-through annular grooves 11, the cylindrical core 2 is being held in the right-hand end position, the turning movement of the cylinder core 2 is not transmitted to the output member 3 of the cylinder lock.

The lateral surfaces of the turn-through annular grooves 11 are constituted by the lateral surfaces of the ribs 12, the end faces of which constitute the inclined blocking groove lateral surfaces 130, 131. After the turning of the cylindrical core 2 by 180°, when the projecting blocking projections 201 of the tumblers 20, 20' come into alignment with the blocking grooves 13, 13', there occurs, under the influence of the pre-stressing of the return spring 4, an axial displacement of the cylindrical core 2 back into the left-hand initial position and to repeated engagement of the coupling 30 between the cylindrical core 2 and the output member 3. In this initial position of the cylinder lock, it is possible once more to either open or close the cylinder lock following the full insertion of the authorized key into the key channel 22.

In the closed position of the cylinder lock (see FIG. 1 and FIG. 5), in which the cylindrical core 2 is located in the left-hand initial position and the coupling 30 is engaged, the first outer collar 251 that is provided on the cylindrical core 2 is in contact with the left-hand lateral surface of the turn-through annular groove 11, the right-hand lateral surface of which is formed by the rib 12 that delimits the first turn-through annular groove 11 on its left side. The second outer collar 252 that is formed on the cylindrical core 2 contacts the right-hand lateral surface of the last rib 12 that delimits the last turn-through annular groove 11 on its right side. The two outer collars 251, 252 are received in the securing grooves 151, 152 with lateral axial leeway a which is equal to or greater than the distance of the axial displacement b that is required for the shifting of the second coupling element 231 out of the first coupling element 301. In this position, the outer collars 251, 252 prevent the extraction of the cylindrical core 2 out of the housing of the cylinder lock.

In the turn-through position of the cylinder lock (see FIG. 1 and FIG. 5), in which the cylindrical core 2 is located in the right-hand end position and the coupling 30 is disengaged, the first outer collar 251 of the cylindrical core 2 contacts the left-hand lateral surface of the first rib 12 and the second outer collar 252 contacts the right-hand lateral surface of the second safety groove 152 provided in the housing 1. In this position, the outer collars 251, 252, first of all, prevent impacting of the cylindrical core 2 into the housing 1 and, secondly, prevent the threading-in of an extraction screw into the key channel 22 of the cylindrical core 2 inasmuch as the cylinder core 2 is displaced, owing to the axial pressure acting on the non-illustrated extraction screw, into its right-hand turn-through position and turns through, as a result of which the threading-in of the aforementioned extraction screw is prevented.

Within the framework of the invention, it is, of course, possible to shape the diverging blocking groove lateral surfaces 130, 131 differently than as planar surfaces. What is important is that the facets must diverge in the direction o of the disengaging axial displacement of the cylinder core 2. It is, of course, also possible to provide a cylinder lock with a disengaging displacement of the cylinder core 2 from the right towards the left. In that case, the inclined blocking groove lateral surfaces 130, 131 are oriented in the opposite fashion and the cylindrical core 2 is displaced, in the course of its attempted turning with an inappropriate key or by application of brute force, axially in the opposite direction. Also, the return spring 4 can be replaced by a helical spring or another resilient element.

As may be perceived from FIGS. 8 to 18 of the drawing, in which there is illustrated the alternative II of the embodiment of the cylinder lock, the entraining member 31 is supported by its outer peripheral surface in an inner hollow space of the housing 1 for turning and axial displacement. The axial extension 23 of the cylindrical core 2 passes through the entraining member 31 which is in a permanent turnfast connection with entraining projections 315 of the output member 3 of the cylinder lock.

When it is attempted to turn the cylindrical core 2 without an appropriate key being fully inserted or by using brute force, the sliding of the blocking projections 201 of the tumblers 20 along the inclined blocking groove lateral surfaces 130, 131 causes an axial displacement of the cylindrical core 2 in the housing 1 against the force of the return spring 4 which is configured in the shape of a helical spring. During the first phase of this displacement, shifting occurs of the second coupling elements 231 formed in the shape of coupling projections on the axial extension 23 out of the first coupling elements 301 formed in the shape of coupling recesses in the entraining member 31 and, furthermore, there occurs contacting of the second axial abutment 26 with the entraining member 31. As a result of this, disengagement of the coupling 30 and, consequently, also disengagement of the cylindrical core 2 from the output member 3 is encountered. During the second phase of the displacement, there occurs, owing to the exertion of pressure by the second axial abutment 26 of the cylinder core 2 on the entraining member 31, further displacement of the latter, as a result of which a turnfast connection with the housing 1 is obtained. This turnfast connection is established as a result of the shifting of the arresting projection 312 provided on the outer end face of the entraining member 31 into the arresting recess 16 that is formed in the housing 1 of the cylinder lock. At the end of the second phase of the displacement of the cylinder core 2, there occurs, as a result of the shifting of the blocking projections 201 of the tumblers 20 out of the blocking grooves 13 provided in the turn-through annular grooves 11, a turnable mounting of the cylindrical core 2 in the housing 1. At this time, the cylindrical core 2 of the cylinder lock can be turned, but this turning movement is no longer transmitted, as a result of the disengagement of the coupling 30, to the entraining member 31 which, in this position, is in turnfast connection with the housing 1. Inasmuch as the entraining member 31 is in permanent turnfast connection with the output member 3, it is also impossible to turn the output member 3 which is connected by a non-illustrated mechanical transmission with a non-illustrated door lock latch.

When it is desired once more to bring the cylinder lock into its operational state in which a fully inserted appropriate key is able to turn the cylindrical core 2 jointly with the output member 3, it is necessary to bring the cylinder core 2 into such an angular position in which the blocking projections 201 of the tumblers 20 are retracted from the turn-through annular grooves 11 and introduced into the blocking grooves 13, 13' and in which the return spring 4 then displaces the cylindrical core 2 back into its left-hand initial position. In this initial position, the cylindrical core 2 is again turnfastly connected by means of the coupling 30 with the entraining member 31 and the entraining member 31 is disengaged from the housing 1.

The aforementioned back displacement of the cylindrical core 2 is again composed of two phases. During the first phase, shifting occurs of the second coupling elements 231 of the axial extension 23 into the first coupling elements 301 of the entraining member 31 with simultaneous engagement of the first axial abutment 25 of the cylindrical core 2 with the entraining member 31, as a result of which there occurs the engagement of the coupling 30. During the second phase, there occurs, as a result of the exertion of pressure by the first axial abutment 25 of the cylindrical core 2 on the entraining member 31, a forced return displacement of the entraining member 31 and, consequently, the shifting of the arresting projection 312 out of the arresting recess 16 provided in the housing 1.

As may be ascertained from FIGS. 3 to 6, the axial extension 23 of the cylindrical core 2 projects from the offset provided in the inner end face 24 of the cylindrical core 2 in which there is formed a blind axial bore 232 for the accommodation of the return spring 4 in the configuration of a helical spring. The pre-stressed return spring 4 is arranged between the cylindrical core 2 and the output member 3 and biases the cylindrical core 2 towards its initial position in which the coupling 30 between the cylindrical core 2 and the entraining member 31 is engaged.

On the axial extension 23, there is provided an annular collar 27 in which there are formed a first radial recess 271 and, opposite to the latter, a second radial recess 272. The two radial recesses 271, 272 constitute the second coupling elements 231 into which there extend, when the coupling 30 is engaged, the first coupling elements 301 of the entraining member 31 that are constituted by radial projections 301'.

Between the annular collar 27 and the inner end face 24 of the cylindrical core 2, there is formed an annular groove 28 the lateral surface 281 of which that faces toward the cylindrical core 2 constitutes the second axial abutment 26 for the entraining member 31. As may best be seen from FIGS. 10 and 13, the first radial recess 271 is formed in the annular collar 27 and extends in the radial direction into the axial extension 23 at least to the level of the bottom of the annular groove 28, wherein the first lateral wall of the first radial recess 271 that faces toward the output member 3 constitutes the first axial abutment 25 of the cylindrical core 2 for the entraining member 31. The second lateral surface of the first radial recess 271 lies in the plane of the annular groove lateral surface 281 and constitutes the second axial abutment 26 of the cylindrical core 2. The second radial recess 272 is formed in the annular collar 27 opposite the first radial recess 271 and extends in the radial direction into the axial extension 23 below the level of the bottom of the annular groove 28 and its lateral wall that faces toward the inner axial end face 24 of the cylindrical core 2 lies in the plane of the second annular groove lateral surface 282 that faces toward the output member 3. In other words, the second radial recess 272 does not extend into the bottom of the annular groove 28 and is terminated in one axial direction exactly at the boundary of the annular groove 28 and the annular collar 27, while it merges in the second axial direction into the second slip-on groove 233 that is provided for the slipping on of the radial projection 301' of the entraining member 3 onto the axial extension 25 of the cylindrical core 2.

The radial projections 301' of the entraining member 31, which constitute the first coupling elements 301, are in contact by their lateral surfaces, when the coupling 30 is engaged, with the lateral surfaces of the first end second radial recesses 271 and 272 provided in the annular collar 27 that constitute the second coupling elements 231, wherein the entraining member 31 is guided by its outer cylindrical peripheral surface radially and axially in the cylindrical hollow space of the housing 1.

As may be observed in FIGS. 14 to 16 and FIG. 18, the entraining member 31 is shaped as a ring having a cylindrical outer peripheral surface, at the end face of which that faces toward the output member 3 there is formed an arresting projection 312 which is destined for the engagement with the arresting recess 16 provided in the housing 1, as well as entraining recesses 314 for the entrainment of the projections 315 of the output member 3. On the opposite end face of the entraining member 31, there is formed an inner end ring 310 from which there project the first coupling elements 301 in the shape of radial projections 301' with concave end faces 313. The concave end faces 313 are in contact, when the coupling 30 is disengaged, with the bottom of the annular groove 28 in which the inner radial projections 301' turn through in the event of an unauthorized turning of the cylindrical core 2. Inasmuch as the separation between the concave end faces 313 corresponds to the diameter D1 of the bottom of the annular groove 28 which is smaller than the diameter D2 of the axial extension 23 behind the annular collar 27, the axial extension 23 is provided with a second slip-on groove 233 which adjoins the second radial recess 272, and an oppositely located first slip-on groove 233'. The bottom of the second slip-on groove 233 is separated from the oppositely located surface of the axial extension 23 or from the bottom of the oppositely located first slip-on groove 233' at the maximum by a distance L that is equal to the diameter D1 of the bottom of the annular groove 28, so that it is possible, during the assembly of the cylinder lock, to slip the inner radial projections 301' of the entraining member 31 onto the axial extension 23.

The embodiment described above renders possible not only a simple manufacture of the cylindrical core 2, of the entraining member 31 and of the housing 1 by injection molding, but also the reduction in the number of the constituent parts of the cylinder lock. It is, of course, also possible within the framework of the invention to provide the first axial abutment 25 on the axial extension 23 by other means, such as, for instance, by an end face of a safety ring mounted in a safety groove situated behind the annular collar 27, or by abutments fastened to the axial extension 23, or with the aid of an end face of a threaded nut that is threaded onto the axial extension 23.

A cylinder lock according to the presented invention can be used in all applications in which it is necessary that it retain its locking function even following an unauthorized forcible manipulation and in which high resistance against the extraction and/or the impacting of the cylinder core out of and/or into the housing, such as, for instance, in motor vehicles.

The invention claimed is:

1. A cylinder lock, especially for motor vehicles, for operating an output member, comprising a housing bounding an inner cylindrical cavity; a cylindrical core with a key channel and a plurality of transverse tumbler passages received in said cylindrical cavity for turning and axial displacement between respective engagement and disengagement positions thereof; means for coupling said cylindrical core with the output member when said cylindrical core is being turned in said engagement position thereof by the appropriate key and for uncoupling said cylindrical core from the output member when said cylinder core is turned by means of an inappropriate key or forcibly by a foreign body; means including respective ribs for bounding a plurality of through-turnable annular grooves that open into said cylindrical inner cavity of said housing; and means for interrupting at least one of said ribs that delimits the respective one of said adjacent through-turnable groove at that axial side thereof that lies opposite to the direction of axial displacement of said cylindrical core toward said disengagement position thereof from the output member to form at least one blocking groove, said interrupting means including blocking groove lateral surfaces that diverge in said direction of axial displacement of said cylindrical core toward said disengagement position thereof; and a plurality of spring-loaded tumblers movably received in said tumbler passages and including respective blocking projections at least one of which protrudes into said blocking groove of said housing when no appropriate key is fully inserted into said key channel and does not protrude into said blocking groove when the appropriate key is fully inserted.

2. The cylinder lock according to claim 1, wherein said housing is composed of two housing halves that are rigidly connected with one another.

3. The cylinder lock according to claim 1, and further comprising means for defining at least one support ring groove opening into said inner cylindrical cavity of said housing; and wherein said cylindrical core includes an outer collar received in said support ring groove with an axial leeway that at least corresponds to a distance of the axial displacement that is necessary for the disengagement of said coupling means.

4. The cylinder lock according to claim 1, wherein said housing includes an additional blocking groove situated at 180° with respect to said one blocking groove, said tumblers being associated with one another in respective pairs such that each of said tumblers of each of said pairs cooperates with a different one of said blocking grooves.

5. The cylinder lock according to claim 1, wherein said blocking groove is symmetrical relative to a symmetry plane with said lateral surfaces thereof being constituted by planar facets each of which encloses the same acute angle with said symmetry plane.

6. The cylinder lock according to claim 1, wherein said coupling means includes an entraining member having first coupling elements; wherein said cylindrical core includes an axial extension that is provided with second coupling elements and a first axial abutment which unequivocally determines said engagement position of said first coupling elements when in engagement with said second coupling elements of said axial extension; and wherein said cylinder core includes a second axial abutment which unequivocally determines said disengagement position of said first coupling elements of said entraining member when out of engagement with said second coupling elements of said axial extension.

7. The cylinder lock according to claim 6, wherein said core has an inner offset surface; wherein said extension includes an annular collar and said second coupling elements are constituted by means for defining a first radial recess and by means for defining an oppositely located second radial recess in said annular collar; wherein an annular groove is formed between said annular collar and said inner offset surface, being axially delimited by a first annular lateral surface that faces toward the inner offset surface and constitutes the second axial abutment, and a second annular lateral surface that faces toward the output member; and wherein said entraining member includes inner radial projections constituting said first coupling elements.

8. The cylinder lock according to claim 7, wherein said axial extension has a diameter at least behind the annular collar that is greater than a bottom diameter of said annular groove; wherein said radial projections of said entraining member have concave end faces that contact the bottom of the annular groove; and wherein said first radial recess is recessed into said axial extension at least to the bottom of the annular groove so that said second annular lateral surface constitutes the first axial abutment, while said second radial recess is recessed into said axial extension below the bottom of the annular groove and is terminated from one side at the first annular lateral surface, while said second radial recess merges in the opposite direction into a second slip-on groove the bottom of which is spaced from an oppositely situated surface of the axial extension at the maximum by a distance which is equal to the diameter of the bottom of the annular groove.

9. The cylinder lock according the claim 7, wherein the diameter of the axial extension behind the annular collar is at most equal to the diameter of said annular groove; and further comprising a securing member mounted on said axial extension behind said annular collar without any leeway and having an end face constituting said first axial abutment.

10. The cylinder lock according to claim 7, wherein said axial extension has a blind bore; and further comprising a return spring accommodated in said blind bore.

* * * * *